33-241 SR
10/21/86 XR 4,617,741

United States Patent [19]
Bordeaux et al.

[11] Patent Number: 4,617,741
[45] Date of Patent: Oct. 21, 1986

[54] ELECTRONIC RANGEFINDER FOR ARCHERY

[76] Inventors: Marvin L. Bordeaux; Dennis R. Ward, both of Rte. 3 Box 2, Willcox, Ariz. 85643

[21] Appl. No.: 682,544

[22] Filed: Dec. 17, 1984

[51] Int. Cl.[4] ..... F41G 1/00
[52] U.S. Cl. ..... 33/228; 33/265; 33/241; 124/87
[58] Field of Search ..... 33/265, 241; 124/87

[56] References Cited

U.S. PATENT DOCUMENTS 3,696,517 10/1972 Larson ..... 33/265
3,945,127 3/1976 Spencer ..... 33/265
4,170,071 10/1979 Mann et al. ..... 33/265
4,220,983 9/1980 Schroeder ..... 33/265
4,325,190 4/1982 Duerst ..... 33/265
4,495,705 1/1985 Kowalski et al. ..... 33/265

*Primary Examiner*—William D. Martin, Jr.
*Attorney, Agent, or Firm*—Cahill, Sutton & Thomas

[57] ABSTRACT

A rangefinding device wherein a series of movable lines are created electronically via the use of a liquid crystal display and associated circuitry. When a target of a known size, such as a deer, is "bracketed" exactly between two of these lines, the correct yardage is indicated on another portion of the liquid crystal display. The device has utility for both hunting and target purposes. The device is battery operated and is small enough and light enough to be mounted on any standard recurve bow, compound bow, or crossbow.

11 Claims, 8 Drawing Figures

TIME BASE GENERATOR
BCD SEVEN SEGMENT DECODER/DRIVER
BCD SEVEN SEGMENT DECODER/DRIVER
YDS
BP
LCD
20 YARD LINE
25 YARD LINE
30 YARD LINE
REFERENCE LINES

ELECTRONIC RANGEFINDER FOR ARCHERY

BACKGROUND OF THE INVENTION

The sport of archery contains many variables which the archer must learn to deal with on a consistently accurate basis in order to be successful. In order for the archer's arrow to strike the target at the point of aim, he must make the necessary horizontal and vertical adjustments for windage and elevation, respectively. In addition he must also be sure that he does not cant the bow to the left or the right. He must also be sure to draw the bow to the same anchor point every time he shoots. If the correct adjustments are not made to accurately control any or all of these variables, then the arrow will most certainly not strike the point of aim. Generally, the archer only aquires the skills necessary to accurately control these variables through experience.

In order for the archer to make the correct vertical adjustment for elevation, he must first be able to accurately judge the distance or range to the target. Of all the variables mentioned above, this is generally considered to be the most difficult task facing the archer, whether it be on the practice range or in an actual hunting situation. Generally, most archers learn to judge the correct distance to the target only by spending long hours in the practice field. However, the optical illusions that can be created by shooting uphill or down hill, or across a depression such as a small canyon, are astounding. Even an experienced archer can misjudge the distance drastically. Thus, a need has been felt for a rangefinding device which is accurate, attaches easily to the bow, and is convenient to use.

Several types of rangefinding devices which attach to the archer's bow are available. These devices and the methods used for finding the range are described in the following patents: Spencer, U.S. Pat. No. 3,945,127 (1976); Duerst, U.S. Pat. No. 4,325,190 (1982); Mann and Schultz, U.S. Pat. No. 4,170,071 (1979); Larson, U.S. Pat. No. 3,696,517 (1972).

SUMMARY OF THE INVENTION

This invention relates to a rangefinding device comprising an energy source and electronic circuitry and associated components which create movable lines within which the target must be bracketed exactly, and electronic circuitry and associated components which display the range of the target in yards, and are powered by said energy source.

It is an object of this invention to provide a rangefinding device which is accurate and easy to use.

It is a further object of this invention to provide a rangefinding device which attaches easily to the bow and is usable even when the archer has the bow in a fully drawn position, ready to shoot.

These and other objects will become apparent from the following description of the preferred embodiments.

DESCRIPTION OF THE PREFERRED EMBODIMENT

Figure 1:
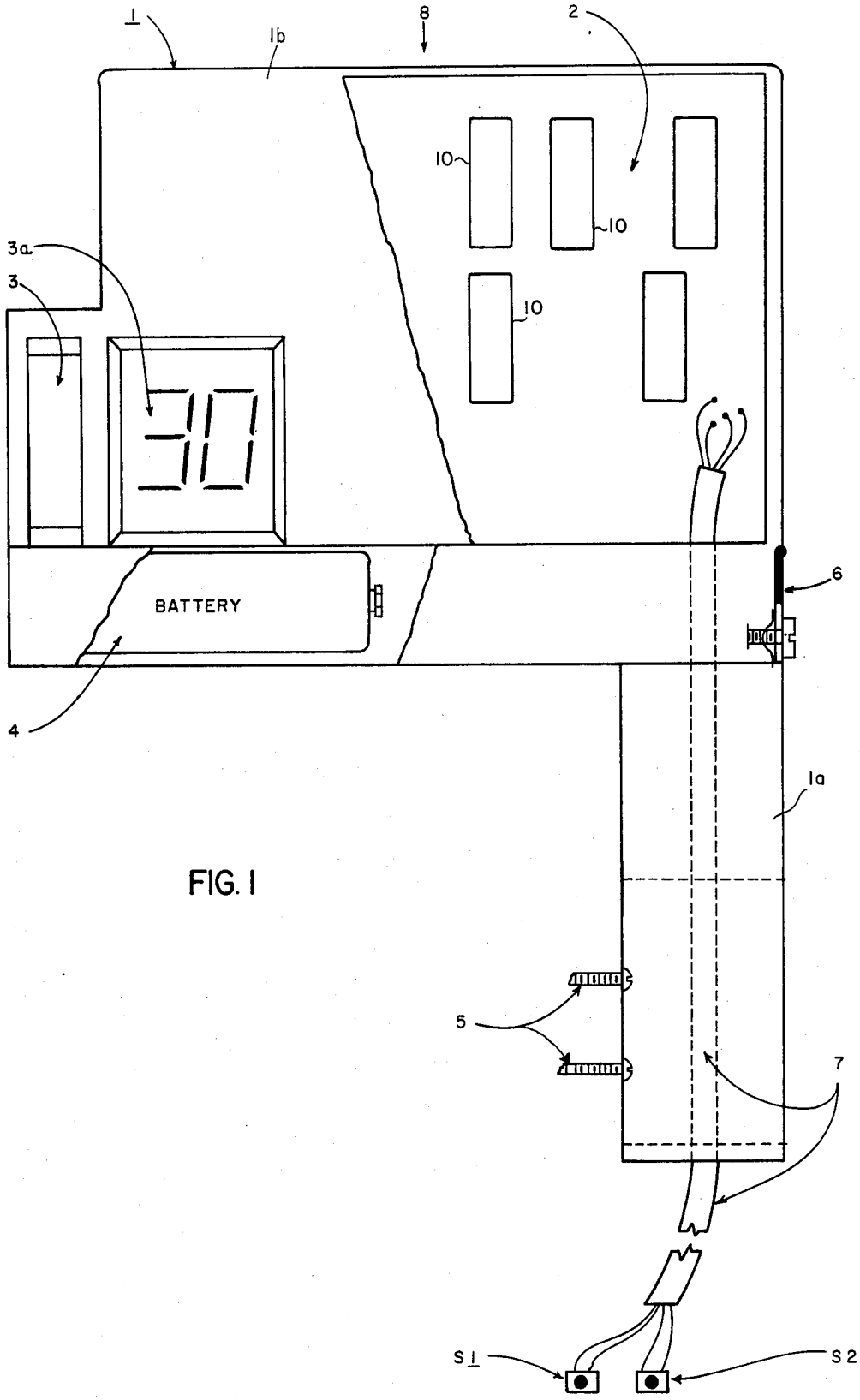
FIG. 1 is a front elevational partial cutaway view of the assembled rangefinding device.

For the purposes of promoting an understanding of the principles of the invention, reference will now be made to the embodiment illustrated in the drawings.

Figure 2:
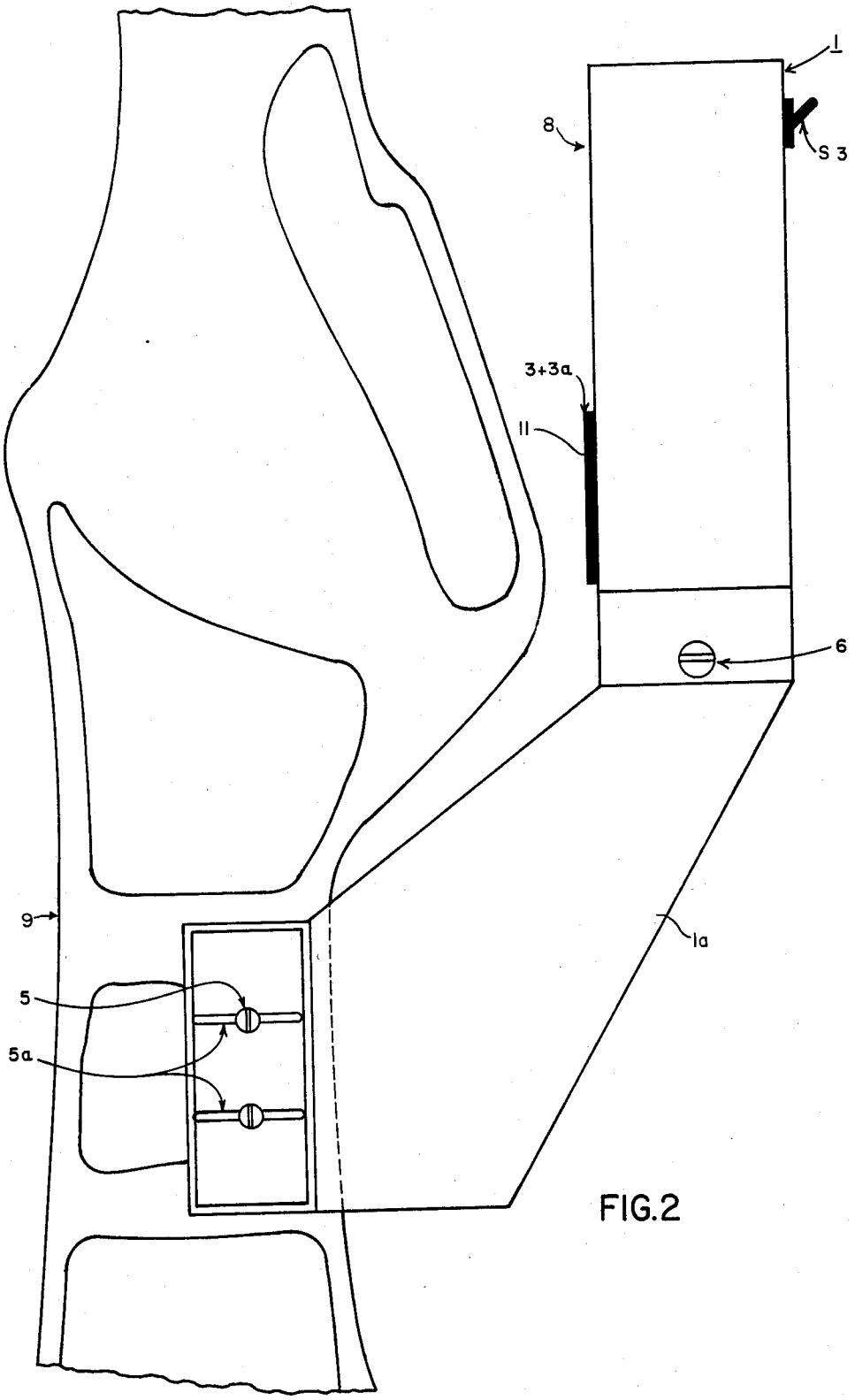
FIG. 2 is a side elevational view showing the assembled rangefinding device as mounted on a bow.
Figure 3:
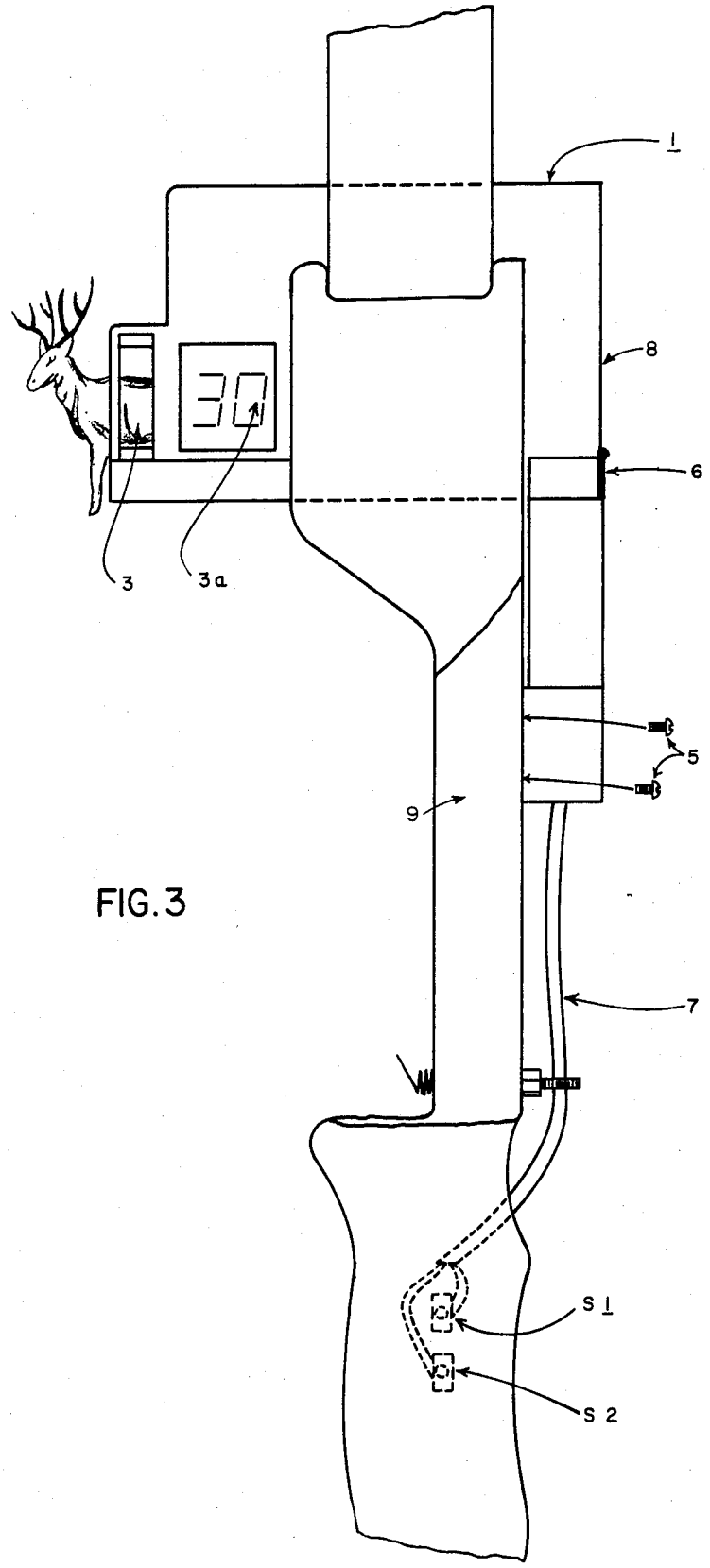
FIG. 3 is a front elevational view showing the assembled rangefinding device as mounted on a bow.

Referring now to FIGS. 1–3, the rangefinding device 8 of the present invention is bolted onto the side of a bow handle 9 by means of a pair of screws 5 that extend, respectively, through a pair of elongated slots **5*a* in a support bracket portion 1*a* of a housing 1 of rangefinding device 8. Housing 1 includes a recess for receiving a battery 4, which is inserted into the recess through a removable battery compartment cover 6. An upper portion 1*b* of the housing supports an LCD (liquid crystal display) rangefinding window that is normally transparent, so that a target can be viewed through it, as shown in FIG. 3. As subsequently explained in more detail, horizontal target bracketing lines can be selected by means of switches S1 and S2 to bracket the target viewed through rangefinding window 3, and a digital display indicating the distance to the thus bracketed target is correspoqdingly displayed on a digital LCD display 3*a* that is also mounted in the upper portion 1b of housing 1**.

As shown in FIG. 3, switches S1 and S2 are mounted on the bow handle grip so that they can be easily actuated by the fingers of the archer's gripping hand to "move", i.e., raise or lower the position of the upper target bracketing line so it brackets the upper portion of the target being viewed through rangefinding window when the bottom bracketing line brackets the lower portion of the target as it appears in the rangefinding window, as illustrated in FIG. 3, and thereby cause the corresponding target distance to be displayed in digital display **3*a***.

As shown in FIG. 1, a circuit board 2 is mounted inside of the upper portion 1b of housing 1. The circuitry on circuit board 2 is responsive to switches S1 and S2 to generate the electrical signals that are necessary to display the target bracketing lines in LCD rangefinding window display 3 and the target distance in digital display **3*a*. A power on/off switch S3 connecting battery 4 to the circuit board 2 is mounted as shown in FIG. 2. A detailed diagram of the circuitry on circuit board 2 is shown in FIGS. 4A–4D**.

The assembled rangefinding device 8 is of a size and configuration that will allow convenient mounting, through the use of mounting screws 5, on any standard recurve bow, compound bow, or crossbow. Slots **5*a* allow adjustment for different draw lengths. Although a right-handed model of the rangefinding device is illustrated and described, both a right-handed and a left-handed model could be provided so that rangefinding window 3 and numerical yardage display 3*a* could be easily seen by either a right-handed or a left-handed archer. Power source 4 is contained within device housing 1, and is accessed through power soure compartment cover 6. Switch cable 7 extends through the bottom of device housing 1 and is connected to switches S1 and S2 which attach to bow handle 9. Circuit board 2 is mounted within the device housing 1 and contains all of the electronic components illustrated in FIG. 4, with the exception of switches S1 and S2, which are mounted to bow handle 9, and S3 which is the on/off switch for power source 4 and is mounted in the location indicated in FIG. 2**.

Referring to FIGS. 4A–4E, the rangefinder is activated by manually closing switch S3, which provides power to the circuitry illustrated in FIG. 4.

As soon as S3 (FIG. 4E) is closed, two black lines appear in the rangefinding window 3. The bottom line is one of four reference lines 25, 26, 27, 28 which can be selected by the archer by closing one of the four switches DS 1–4 (FIG. 4A) on circuit board 2, subsequently described. The appropriate one of reference lines 25–28 is chosen according to the size of the game animal or target which the archer is shooting at. The top line 20 that automatically appears is referred to as the 20 yard line. So when a target of a known size will fit exactly between the top line 20 and the bottom reference line selected, the archer knows that the target is 20 yards away, because the position of the twenty yard target bracketing line semgnt 20 has been positioned so that a triangle having an apex at the eye of the archer and having one line passing through the selected bottom reference line 25 and the twenty yard bracketing line 20 will pass across the bottom and top portions, respectively, of the preselected target if it is twenty yards from the rangefinding device. At the same time the numeral 20 will appear on the nuerical display portion 3*a* of the liquid crystal display (LCD). Similarly, if a target of known size fits exactly between the selected bottom reference line and the 25 yard line, the numeral 25 will be displayed in the digital LCD display 3*a* when the 25 yard line is selected by appropriately depressing momentary switches S1 and S2. In this manner, the archer does not have to count lines or remember colors to know the yardage; he simply has to glance at the display and read the correct yardage.

Figure 4A:
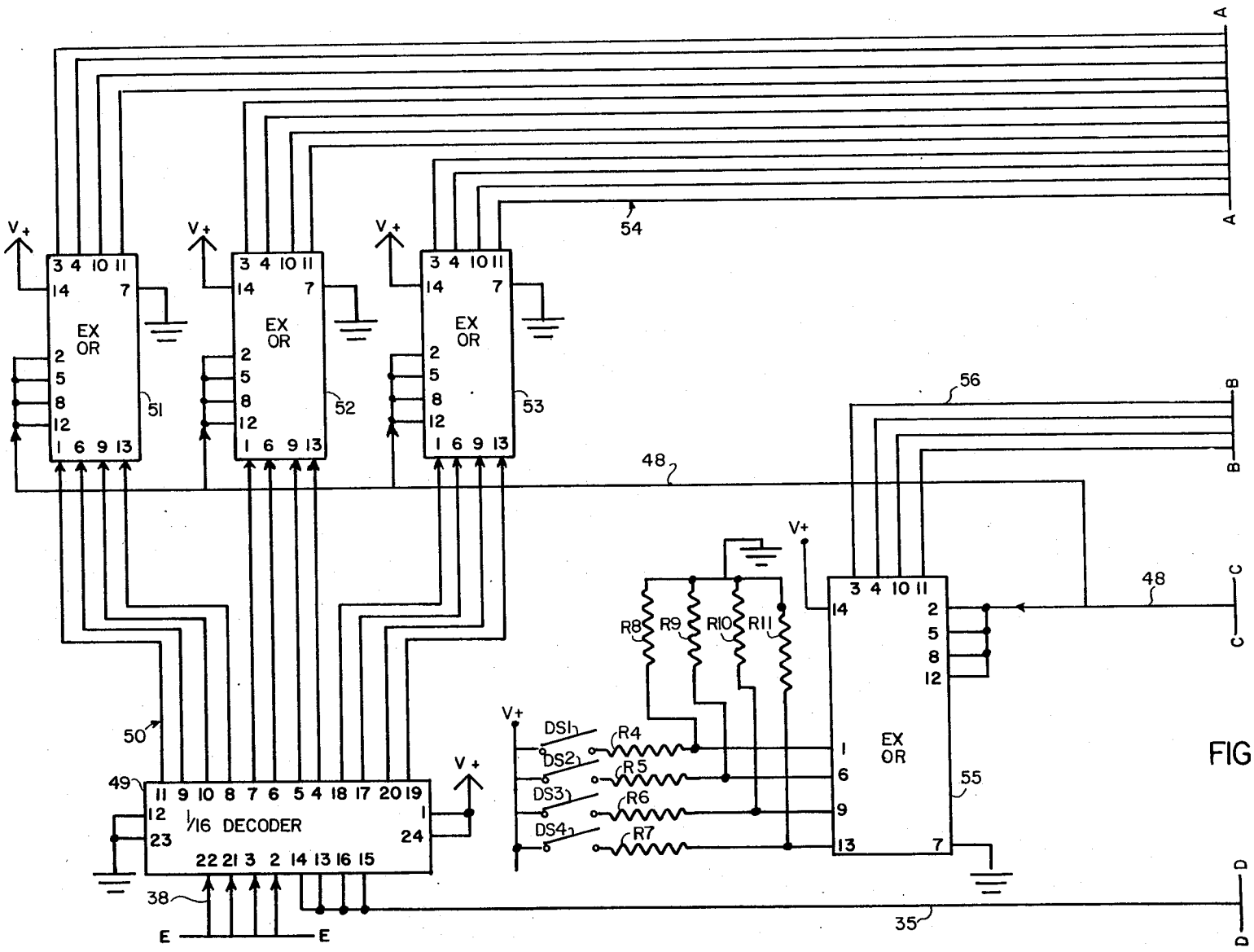
FIGS. 4A–4E constitute a schematic diagram of the electronic circuit employed in the present rangefinding device.
Figures 4B, 4E:
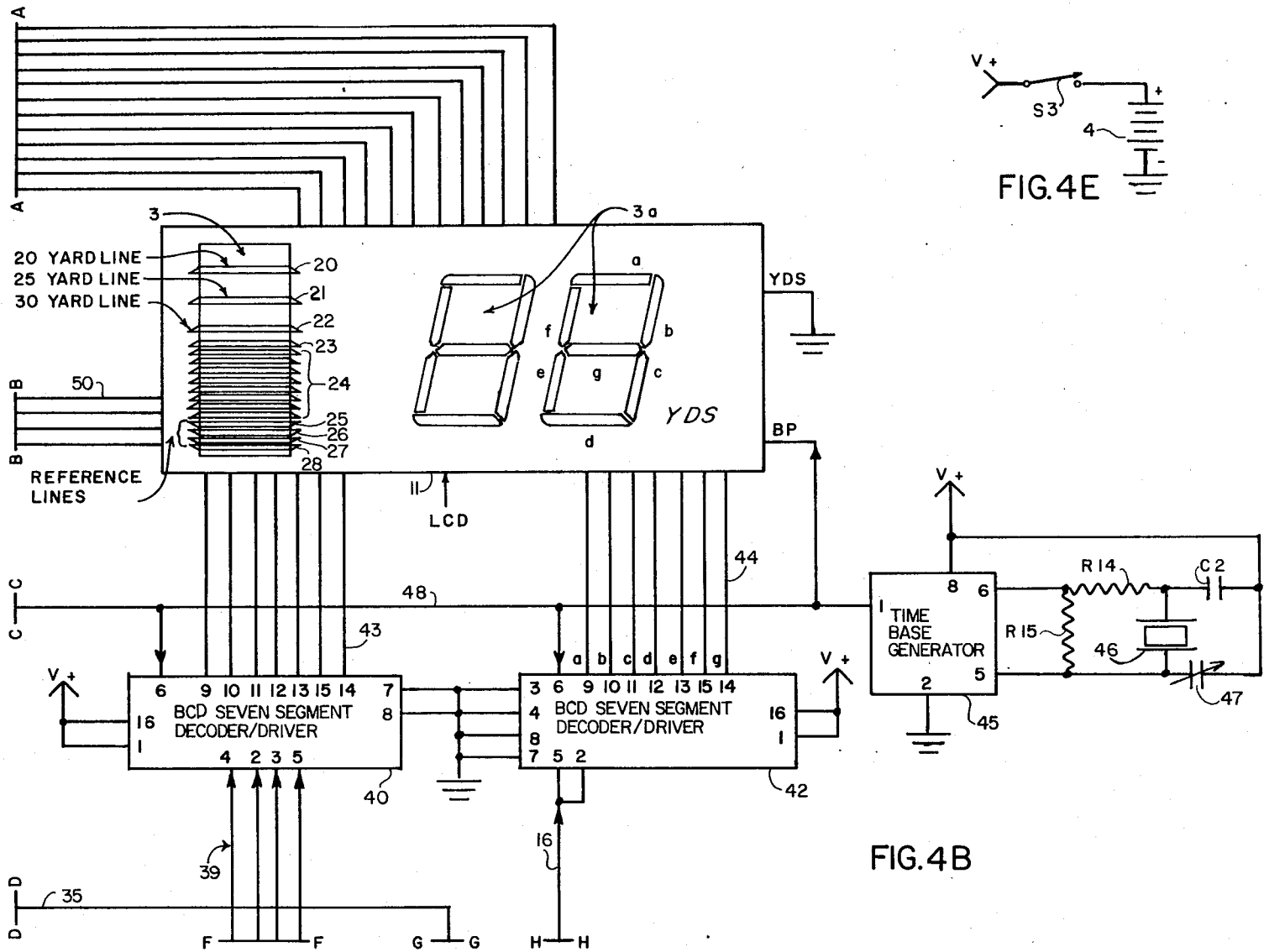
Figure 4C:
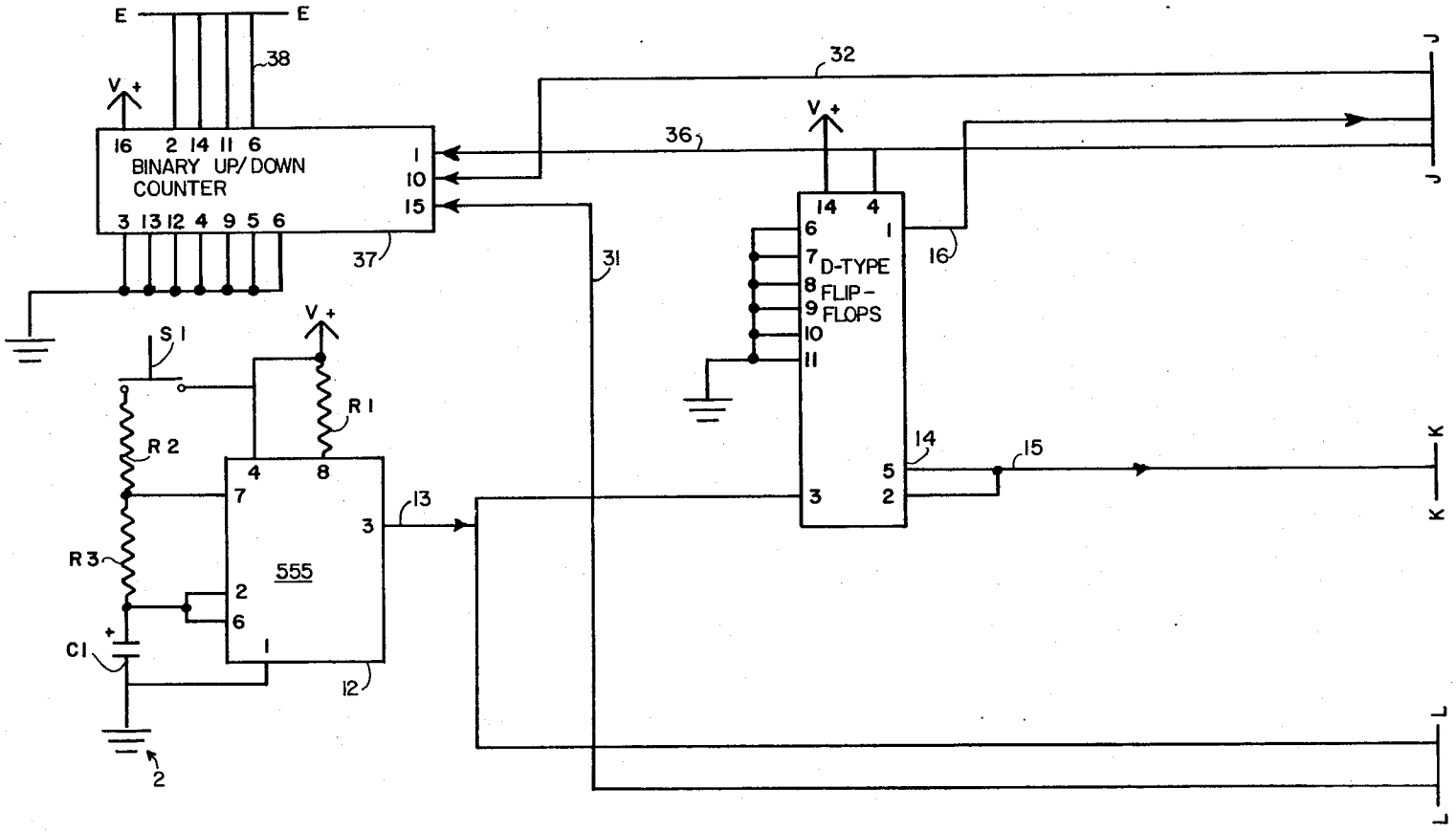
Figure 4D:
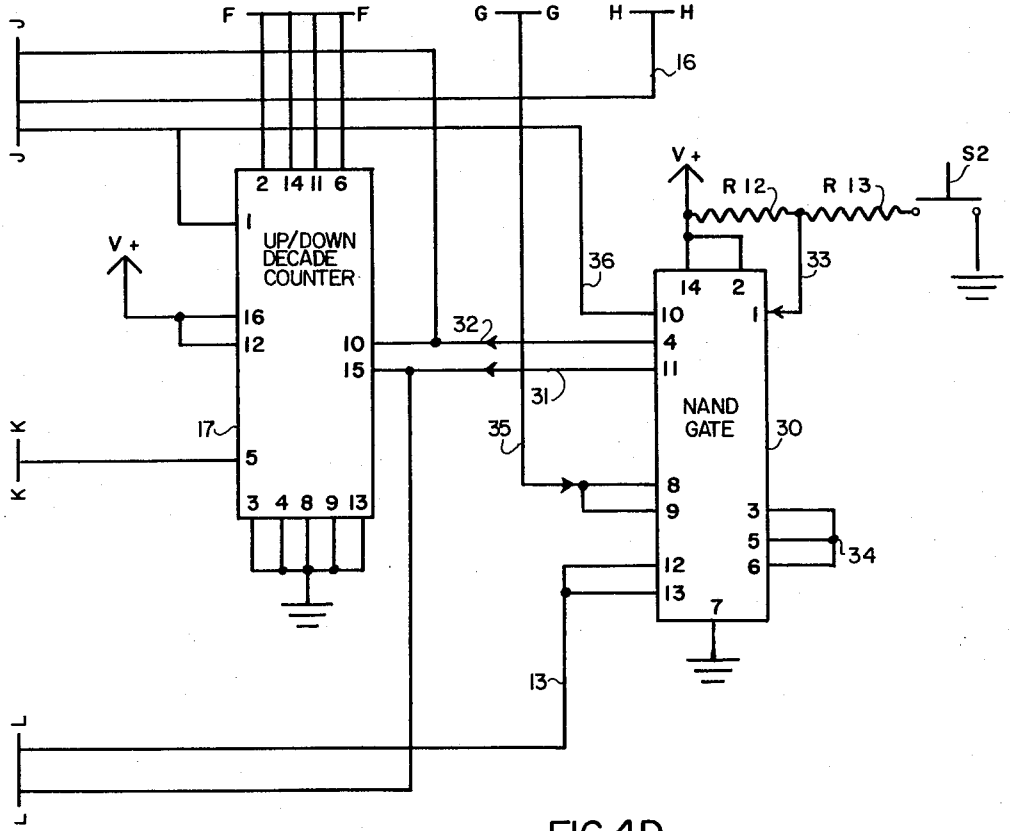

The detailed circuitry on circuit board 2 will next be described with reference to FIGS. 4A–4E. FIG. 4E shows the connection of battery 4 between a ground conductor and one terminal of switch S3, the other terminal of which is connected to a V+ conductor. Switch S1 is connected between V+ and an input of a conventional 555 timer designated by reference numeral 12 by means of a resistor R2. Resistors R2, R3, and capacitor C1 establish the frequency of a square wave output pulse produced on conductor 13 by timer circuit 12, which is connected as a multi-vibrator when momentary switch S1 is depressed, but remains in its present state when momentary switch S1 is released.

Conductor 13 is applied to a D-type flip-flop in block 14. The flip-flop produces a "count enable" signal on conductor 15, and also produces a signal on conductor 16, each having half the frequency of the signal on conductor 13, and having complementary levels. Conductor 13 is connected to block 30, which contains four 2 input NAND gates. Gates 12 and 13 are connected to the inputs of one of the NAND gates to provide an output on conductor 31, which is a logical complement of the signal on conductor 13. Conductor 31 is connected to the "increment" or "count" input of an up/down decade counter 17. The "count enable" input of up/down decade counter 17 is connected to the conductor 15.

The direction of counting of up/down decade counter 17 in response to the signal on conductor 31 is determined by the logic level on conductor 32. The counting direction or up/down signal (i.e., the signal that determines whether the counting is an incrementing or a decrementing) on conductor 32 is produced in response to the state of direction switch S2. If momentary switch S2 is depressed, a logical "0" is produced on conductor 32, causing decade counter 17 to count down. If momentary switch S2 is not depressed, decade counter 17 increments or counts up in response to the count signal produced on conductor 13 by depressing momentary switch S1.

The counting signal on conductor 31 also is applied to the increment input of a second up/down counter 37. The count direction signal on conductor 32 is applied to the up/down input of counter 37.

Four outputs 39 of up/down decade counter 17 are applied to four inputs of a BCD seven segment decoder/driver circuit 40, seven outputs of which are connected to a liquid display unit 11 that contains both LCD digital display section 3*a* and rangefinding window 3. The outputs 43 of BCD seven segment decoder/driver circuit 40 apply a 60 hertz square wave on conductor 48 to selected corresponding segments of the tens digit of LCD display 3*a*, in a 180° out-of-phase relationship to the 60 hertz signal being connected to the back plane (BP) of LCD display 11 by conductor 48. The 60 hertz square wave on conductor 48 is generated by a time base generating circuit 45, which operates at a frequency set by crystal 46, and has a duration determined by capacitors C2 and 47 and resistors R14 and R15. A second BCD seven segment decoder/driver 42 has two inputs connected to conductor 16. Seven outputs 44 of BCD seven segment decoder/driver 42 are connected to the LCD segments of the units digit of digital display 3A, so that the 60 hertz square wave on conductor 48 is applied, in 180° out-of-phase relationship with the 60 hertz signal applied to the back plane, to the selected LCD segments of the units digit of LCD digital display 3*a*.

The connections between up/down decade counter 17, divide by 2 flip-flop 14, BCD seven segment decoder/drivers 40 and 42, and the segments of digital display 3*a* are such that when momentary switch S1 is being depressed, the units digit of LCD display 3*a* alternately switches approximately every second between "zero" and "five" in response to successive pulses on conductor 13, and the tens digit of LCD digital display 3*a* is decremented or incremented (depending on upon whether direction switch S2 is depressed) every other pulse on conductor 13.

Four outputs 38 of binary up/down counter 37 are connected to four inputs of one-of-16 decoder 49, 12 outputs of which are each connected, respectively, to one input of each of 12 exclusive OR gates contained in blocks 51, 52, and 53. The second input of each of the exclusive OR gates is coupled to the 60 hertz square wave signal on conductor 48, which is also connected to inputs of four exclusive OR gates contained in block 55 and two inputs of BCD seven segment decodes 40 and 42. The outputs 54 of the exclusive OR gates in blocks 51–53 are respectively connected to the various LCD front plane segments of the 12 upper lines shown in rangefinder LCD window 3. Those skilled in the art will realize that LCD segments 20, 21, 22, and 23, which represent the 20, 25, 30, and 35 yard lines or distances to a bracketed, viewed target of a preselected size, are transparent when the 60 hertz signal being applied thereto is in phase with the 60 hertz signal being applied to the back plane of the LCD display. The next group of more closely spaced front plane LCD segments, designated by reference numeral 24, correspond to additional five yard increments in the distance to the "bracketed" target.

The four lowest target bracketing lines designated by reference numerals 25, 26, 27, and 28, respectively, are reference lines that can be preselected by switches DS1, DS2, DS3, and DS4, respectively, in accordance with the estimated size of the target being viewed. Switches DS1–4 are simply connected to exclusive OR gates in block 55, which invert the 60 hertz signal on conductor 48 and produce a 180° out-of-phase signal on the corresponding one of conductors 56, thereby making the "selected" LCD reference line visible or opaque. The bottom of the viewed target then is aligned with the "selected" reference line, as shown in FIG. 3. Then, one or both of momentary switches S1 and S2 are depreseed to, in effect, raise or lower the displayed visible upper targeting bracketing line until it is aligned with the top of the viewed target. Simultaneously, the digital readout 3*a* indicates the distance to the target represented by the presently displayed upper bracket line.

When the power on/off switch 53 initially is closed, thereby applying the battery voltage to the circuitry in FIGS. 4A–4D, one-of-16 decoder circuit 49 produces a signal on conductor 35 which is inverted by a NAND gate in block 30 and produces an intialization signal on conductor 36. The initialization signal on conductor 36 sets the initial states of up/down counter 17 and 37 so that a "20" is displayed in digital display 3*a*, and the top bracketing twenty yard line 20 is displayed in rangefinding window 3.

The following sequence of events occurs when switch S1 is pressed momentarily: 555 timer 12 generates a pulse which is transmitted on pin 3 of 555 timer 12. This pulse reaches pin 3 of D-type flip-flop circuit 14 and sets pin 1 of 555 timer 12 to a logical "1" and sets pins 2 and 5 to a logical "0". The logical 1 from pin 1 of D-type flip-flop circuit 14 reaches pins 2 and 5 of BCD to 7-segment decoder/driver 42, and along with pins 3 and 4 of BCD seven segment decoder/driver 42 which are at a logical "0", sets pins 9,15,14,11 and 12 to a logical 1, which blacks out the corresponding LCD segments of the units portion of the numerical display 3*a*, creating a display of the digit "5" in the units position. The logical "0" on pins 2 and 5 of D-type flip-flop circuit 14 is applied to pin 5 of up/down decade counter 17, which inhibits the count. Thus the pulse arriving from pin 3 of 555 timer 12 does not increment the counter, so the digital number "2" being displayed in the tens position of display 3*a* remains as is. So now a decimal 25 is displayed on digital display 3*a*. (Recall that when power is turned on, the digital number "20" appears in LCD digital display 3*a*.) (Recall that when power is turned on, the digital number "20" appears in LCD digital display 3*a*). At the same time, the pulse transmitted 555 timer on pin 3 of 12 arrives at pin 15 of binary up/down counter 37, from pin 11 of a NAND gate in block 30 and increments up/down counter 37. So now a binary coded one is applied to pins 2,3,21 and 22 of 1 of 16 decoder 49, from pins 2,6, 11 and 14 of up/down counter 37. Now a logical "0" appears at pin 9 of one of 16 decoder 4gr, and is in turn applied to pin 6 of exclusive or gate 51. A square wave is being applied to pin 5 of exclusive or gate 51 from pin 1 of crystal controlled time base generator 45. As a logical "0" is applied to pin 6 of exlcusive or gate S1 the output of the NAND gate, pin 4 of exclusive or gate S1, goes to a logical 0, thus removing the square wave from pin 4 of exclusive OR gate S1, which causes the 25 yard line 21 to appear in rangefinding window 3. At the same time a logical "1" appears at pin 11 of one-of-16 decoder 49 and is thus applied to pin 1 of exclusive OR gate S1. This enables the exclusive OR gate and allows the in-phase 60 hertz square wave to appear on output pin 3 of exclusive or circuit S1, thus turning off the 20 yard line in rangefinding window 3. This same basic sequence of events occurs every time switch S1 is momentarily pressed to "decrease" the presently displayed bracket line by five yards and produce a corresponding digital readout that is lower than the last one by five units.

Now if switches S1 and S2 both are momentarily pressed essentially, the same sequence of events takes place, but with the following exceptions: By momentarily pressing S2, a logical "0" is applied to pin 10 of up/down decode counter 17 and to pin 10 of binary up-down counter 37 from pin 4 of IC6. This logical "0" causes both counters 17 and 37 to decrement by one every time a counting pulse is received from pin 11 of a NAND gate in block 30. So in essence the rangefinder is counting backwards thus eliminating the need to cycle through the entire range of the range finder to obtain a lesser yardage indication.

As mentioned previously, one of the four reference lines 25–28 may be chosen by closing one of the four switches switch DS 1–4. If DS 1 is closed a logical "0" is applied to pin 1 of an exclusive OR gate in block 55, thus causing an out-of-phase 60 hertz square wave to appear on pin 3 of an exclusive OR gate in block 55. This in turn causes the top reference line 20 to appear in rangefinding window 3. If switch DS 1 were now opened again, a logical "1" would be applied to pin 1 of an exclusive OR gate in block 55 and the in-phase 60 hertz square wave would again appear on pin 3 of an exclusive OR gate in blank 55 V thus removing the top reference line 20 from rangefinding window 3. Similarly, switches DS2, DS3, and DS4 can be close to darken reference lines 26, 27, and 28, respectively. This feature is provided to allow the archer to accurately use the rangefinder for different size targets and/or game animals.

While the invention has been illustrated and described in detail in the drawings and foregoing description, the same is to be considered as illustrative and not restrictive in character, it being understood that only the preferred embodiment has been shown and described and that all changes and modifications that come wihtin the spirit of the invention and the scope of the claims are also desired to be protected.

The invention claimed is:

1. A rangefinding apparatus for attachment to a bow, comprising in combination:

(a) a transparent viewing window through which a target having a first preselected size can be viewed by an archer aiming the bow in a drawn configuration at the target;

(b) first display means for selectively displaying an upper target bracketing line and a lower target bracketing line in the transparent viewing window, the lower bracketing line being below and spaced from the upper target bracketing line, the location of the lower target bracketing line being selected for the first preselected size target;

(c) second display means for displaying a digital number corresponding to a distance between the upper target bracketing line and the first lower target bracketing line, and hence to the distance from the rangefinding apparatus to the target;

(d) upper bracketing line control means for effectively moving the upper target bracketing line in response to a control switch actuated by a finger of the archer's hand gripping a handle of the bow to cause the upper target bracketing line to visually bracket an upper portion of the target as seen through the transparent viewing window by the eye of the archer when the bow is aimed so that the lower target bracketing line appears to bracket a lower portion of the target; and (e) digital display control means responsive to the control switch for causing the second display means to automatically display a digital number corresponding to the position of the displayed upper target bracketing line and hence to the distance from the rangefinding apparatus to the target.

2. The rangefinding apparatus of claim 1 further including lower bracketing line control means for effectively moving the lower target bracketing line to a position that corresponds to the first preselected size of the target so that the digital number displayed when a target of the first preselected size is bracketed by the upper bracket line and the lower bracket line accurately indicates the distance from the rangefinding apparatus to the target.

3. The rangefinding apparatus of claim 2 wherein the first and second display means are included in a liquid crystal display device that displays the upper and lower target bracketing lines and displays the digital number.

4. The rangefinding apparatus of claim 3 wherein the upper bracketing line control means and the digital display control means are included in an electronic circuit including means for generating liquid crystal segment control signals that cause the upper target bracketing line to appear in selected locations of the transparent viewing window and means for generating liquid crystal segment control signals that cause a corresponding digital number to appear in the second display means.

5. The rangefinding apparatus of claim 4 wherein the control switch is attached to a front portion of the bow handle so that a finger of the archer's bow handle gripping hand can conveniently actuate the control switch to thereby effectively raise or lower the upper target bracketing line to bracket the upper portion of the target

6. The rangefinding apparatus of claim 1 including adjustable mounting means for attaching the rangefinding apparatus to the bow to provide a predetermined distance. between the transparent viewing window and the eye of the archer holding the bow in a drawn configuration.

7. The rangefinding apparatus of claim 6 wherein the transparent rangefinding window is disposed on the same side of the bow as an arrow being aimed at the target.

8. A method for operating an electronic rangefinding apparatus attached to a bow to indicate the distance from the bow to a target of a preselected size, the method comprising the steps of:

(a) providing a transparent viewing window and a digital display in a housing of the rangefinding apparatus, and providing a movable bracket line display in the transparent viewing window;

(b) providing a digital display in the housing of the rangefinding apparatus;

(c) producing a first electrical signal and applying it to the movable bracket line display to generate a lower bracket line in the transparent viewing window at a first location corresponding to the preselected size of the target;

(d) producing a second electrical signal in response to a control switch and applying the second electrical signal to the movable bracket line display to generate an upper bracket line in the transparent viewing window at a second location that brackets an upper portion of the target as seen in the transparent viewing window by the eye of an archer aiming the drawn bow at the target so that the lower bracket line brackets a lower portion of the target as seen in the transparent viewing window; and (e) automatically producing a third electrical signal that corresponds to the second location and applying the third electrical signal to the digital display to cause it to display a digital readout that corresponds to the distance between the first and second locations of the upper and lower bracketing lines, respectively, and hence to the distance from the bow to the target.

9. The method of claim 8 including producing the first electrical signal in response to selective actuation of a switch.

10. The method of claim 9 wherein the control switch is mounted on a forward portion of a handle of the bow, wherein producing the second signal in response to the control switch is accomplished by the archer actuating the control switch with a finger of his hand gripping the handle of the bow.

11. The method of claim 8 including producing an initial location of the upper bracketing line in the transparent viewing window and displaying a corresponding digital readout in the digital display in response to turning on a power switch of the electronic rangefinding apparatus.

* * * * *